US008141494B2

(12) United States Patent
Riess et al.

(10) Patent No.: US 8,141,494 B2
(45) Date of Patent: Mar. 27, 2012

(54) PARTIAL DECOMPOSITION WITH A MASSIVE CORE AND CORE MADE OF PRESSED POWDER

(75) Inventors: Heinz Riess, Fürth (DE); Erich Muskat, Roth (DE)

(73) Assignee: RUAG Ammotec GmbH, Furth (DE)

( * ) Notice: Subject to any disclaimer, the term of this patent is extended or adjusted under 35 U.S.C. 154(b) by 1145 days.

(21) Appl. No.: 10/567,090

(22) PCT Filed: Jul. 30, 2004

(86) PCT No.: PCT/EP2004/008589

§ 371 (c)(1),
(2), (4) Date: Aug. 6, 2009

(87) PCT Pub. No.: WO2005/017442

PCT Pub. Date: Feb. 24, 2005

(65) Prior Publication Data

US 2009/0293755 A1 Dec. 3, 2009

(30) Foreign Application Priority Data

Aug. 5, 2003 (DE) ..... 103 35 711
Jul. 21, 2004 (DE) ..... 10 2004 035 385

(51) Int. Cl.
*F42B 12/74* (2006.01)

(52) U.S. Cl. ..... 102/516; 102/506; 102/517; 102/501; 102/507

(58) Field of Classification Search ..... 102/506, 102/507, 516, 517, 518, 501, 439, 444, 473, 102/498, 529
See application file for complete search history.

(56) References Cited

U.S. PATENT DOCUMENTS

| | | | | |
|---|---|---|---|---|
| 4,850,278 | A * | 7/1989 | Dinkha et al. | 102/501 |
| 4,939,996 | A | 7/1990 | Dinkha | |
| 7,150,233 | B1 * | 12/2006 | Eberhart | 102/516 |
| 7,404,359 | B2 * | 7/2008 | Muskat et al. | 102/516 |
| 7,509,911 | B2 * | 3/2009 | Muskat et al. | 102/516 |
| 7,934,454 | B2 * | 5/2011 | Campo et al. | 102/502 |

FOREIGN PATENT DOCUMENTS

| | | |
|---|---|---|
| DE | 102 39 910 | 10/2003 |
| EP | 0 997 700 | 5/2000 |
| WO | WO 97/20185 | 6/1997 |
| WO | WO 00/73728 | 12/2000 |

* cited by examiner

*Primary Examiner* — James Bergin
(74) *Attorney, Agent, or Firm* — Antonelli, Terry, Stout & Kraus, LLP.

(57) ABSTRACT

The decomposition of a projectile in a target body, particularly a hunting projectile in wild animals after penetration therein, determines the energy output of the projectile and thereby the effect of the shot. For projectiles with double cores, the properties of the ingredients used in the cores decisively affect the decomposition and particularly the deformation behavior of the cores. According to the invention, a partial decomposition projectile comprising two cores is provided with one solid core (3) made of a material suited to said projectile and the second core (4) is made of a powder (5) consisting of metal or ceramic ingredients, said powder being pressed to become free of shrink holes, in order to improve decomposition behavior control.

22 Claims, 1 Drawing Sheet

PARTIAL DECOMPOSITION WITH A MASSIVE CORE AND CORE MADE OF PRESSED POWDER

The invention relates to a disintegrating bullet according to the preamble of the first claim.

The disintegration of a bullet in the target body, in particular of a hunting bullet in the body of game animals following penetration thereof, determines the energy released by the bullet and hence the effect of the shot. A different form of disintegration is necessary in the case of weak game, for example, to that required for high game. DE 102 39 910 A1 discloses a disintegrating hunting bullet in the form of a jacketed bullet. It may be both a partially jacketed and a fully jacketed bullet, the bullet core of which consists of balls or granules, compressed without cavities, made from a metallic material. Suitable materials for the balls or granules include any materials, for example lead or lead-containing alloys, that may be compressed to form a core without cavities. For reasons of environmental protection, to advantageously prevent the contamination of soil and game, lead-free materials are preferably used.

The compressed bullet core, which consists of balls or granules and is held by the bullet jacket, disintegrates, along with the bullet jacket, on impact in the target body differently from a solid core. The diameter of the balls or the particle size of the granules determines both the released energy and the predetermined breaking points in the bullet core, and thus the size of the individual parts produced when said core disintegrates. Larger balls or granule particles penetrate the target medium more deeply and produce a further-reaching destructive channel in the tissue than a number, comparable in terms of mass, of smaller balls or granule particles. As a result of the compression of the material of the core, sharp edges, which increase the effectiveness of the fragments, are obtained on the compressed balls or granule particles.

WO 01/20244 A1 and WO 01/20245 A1 disclose deformable bullets consisting respectively of two solid cores, one core being what is known as the penetrator, which is arranged in the tail or in the nose of the bullet and significantly affects the disintegration and, in particular, the deformation characteristics of the bullet. In the case of these bullets, a slight loss in mass of the cores and an expulsion, with a defined residual size of the bullet, occur.

The object of the invention is further to improve the disintegration characteristics of a bullet comprising two cores.

The object is achieved in that the bullets according to the invention comprise a respective solid core, i.e. a core made from solid material, in the tail or in the nose of the bullet and a second core, which is not solid, but rather consists of powder compressed without cavities, and is located before or after the solid core. The solid core and the powder core may be made from different materials suitable for bullets, although the optimal position of the centre of gravity, with respect to the ballistics, has to be ensured in the configuration of the cores.

The particle size of the powder is determined by the desired energy release and deep action of the individual powder particles in the target body. Large powder particles have a high degree of deep action, while small powder particles have only a low degree of deep action, in particular in the body of game animals. The particle size of the powder is therefore, depending on the desired effect, between 50 μm and 1 mm.

Sintered materials and binders are also advantageous, wherein, in the case of materials that are relatively difficult to compress, binders may be provided as fillers between the compressed powder particles.

The bullet core consisting of powder may be compressed in the jacket or be introduced into the jacket in prefabricated form, i.e. precompressed into the bullet shape without cavities.

The compacting pressure is determined by the particle size and is preferably between 1.5 and 4 tonnes.

Predetermined breaking points in the jacket are advantageous if disintegration of the bullet is desired immediately on impact or at low penetration depth or at relatively low projectile speeds. The predetermined breaking points extend in the axial direction and are located on the inside of the jacket, preferably in the ogival region. The disintegration of the bullet can be affected by the number and the position of the predetermined breaking points in the jacket. The closer toward the tip of the bullet the predetermined breaking points are located, the more the jacket swells and is disintegrated into fragments. Further predetermined breaking points may be notches extending radially on the outer perimeter, for example a sharp edge in the case of hunting bullets. A tearing edge, for example a sharp edge, at the junction with the solid core causes the jacket to become torn off. Holding grooves, on the other hand, cause the bullet jacket to be secured to the bullet core.

Suitable materials for the jacket include, in particular, copper, alloys thereof, plated steel, soft iron and zinc/tin alloys.

As a fully jacketed bullet comprising a completely compressed core, it can be used as a practice bullet. The advantages include low contaminant levels, while not using lead materials. When the bullet strikes a butt, the jacket swells, tears and the core immediately disintegrates into its individual parts and thus consumes all of its stored energy. Damage to the butt is thus advantageously avoided.

The solid core may also consist of compressed balls or granules, intensive compaction without cavities being advantageous. A solid core made from sintered materials is also possible.

The core of a fully jacketed or partially jacketed bullet may also consist entirely of compressed powder. A bullet of this type could be used as a practice bullet.

The described construction of the bullet core is suitable for all disintegratable bullet types. The possibilities indicated for configuring the core of a bullet allow bullets to be produced that are adapted to the respective purpose of use and that achieve a respective optimal effect at any impact speed owing to their disintegration characteristics, which are adapted to this speed.

The invention will be described in greater detail with reference to embodiments.

Figure 3:
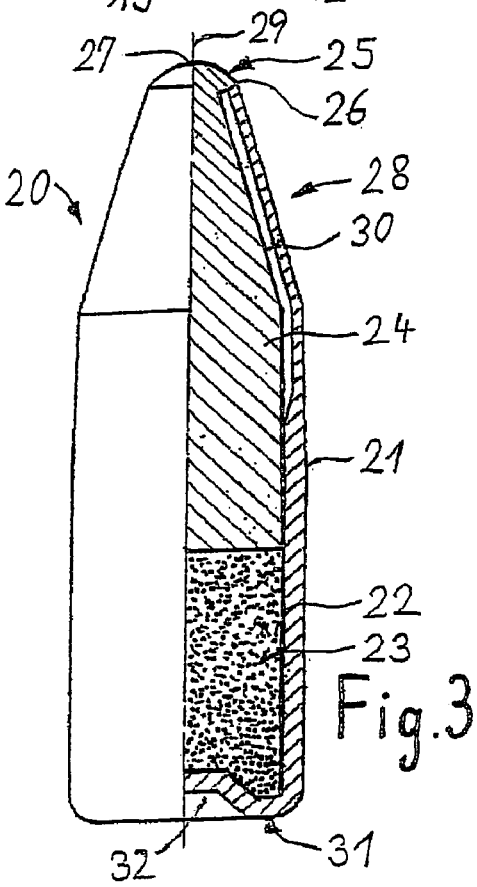
Figure 4:
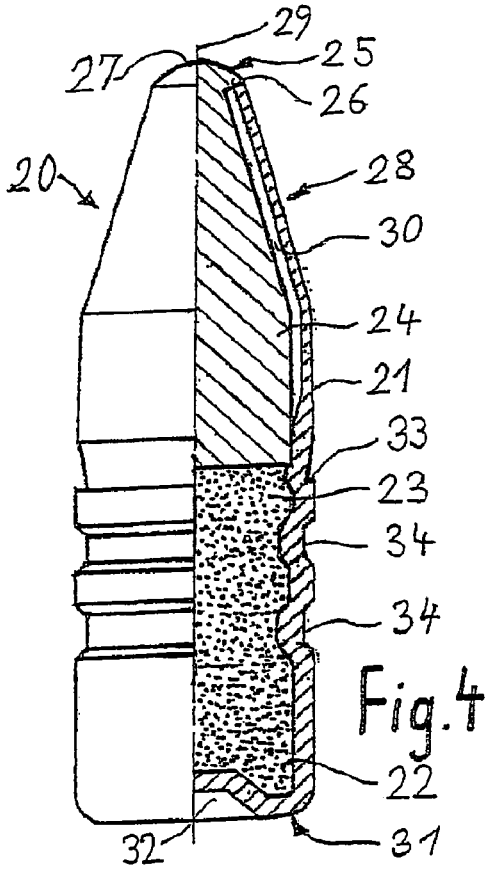

FIG. 3 is a schematic view, half in section, of a partially jacketed bullet comprising a solid nose core and a tail core consisting of powder compressed without cavities; and FIG. 4 is a schematic view, half in section, of a partially jacketed bullet in the form of a disintegrating bullet, the core arrangement corresponding to FIG. 3, in which the jacket additionally contains a sharp edge and two holding grooves.

Figure 1:
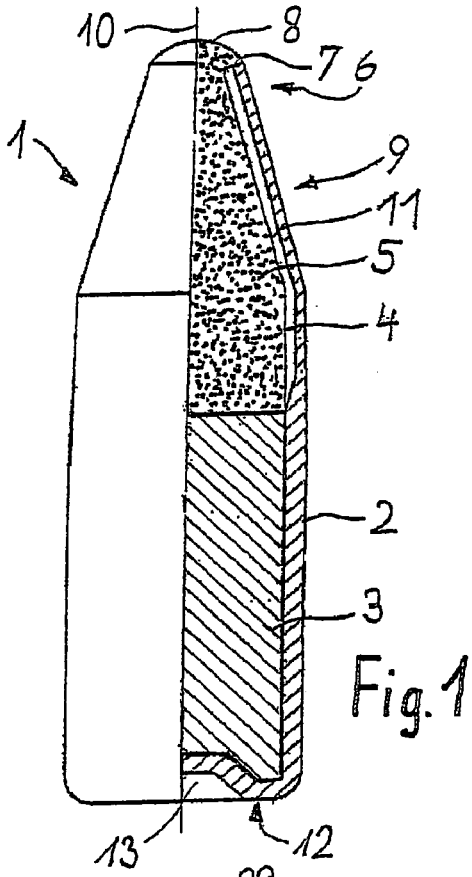
FIG. 1 is a schematic view, half in section, of a partially jacketed bullet in the form of a disintegrating bullet comprising a solid tail core and a nose core consisting of powder compressed without cavities.

FIG. 1 shows a partially jacketed bullet 1. A solid core 3, which is made from a material suitable for a bullet core, is inserted into the bullet jacket 2, which is initially non-deformed and open. A suitable powder 5 is added and then compressed without cavities to form the second core 4. Suitable powder materials include materials such as, for example, ball or granule particles, sintered metals and binders. The bullet jacket 2 is then drawn onto the illustrated bullet shape. The bullet jacket 2 is not closed in the bullet nose 6. The bullet core 3 protrudes from the opening 7 in the jacket 2 and forms the bullet tip 8. In the ogival region 9, predetermined breaking points, in the form of grooves 11 pressed into the jacket 2, extend on the inside of the jacket 2 in the direction of the axis 10 of the bullet 1. A spherical indentation 13 is located in the tail 12 of the bullet 1 for stabilising the motion of the bullet and thus for increasing precision.

Following impact in the target body, the bullet jacket opens, the compressed core disintegrates into its individual parts and releases the desired energy to the game. Owing to the compressed core, the same energy is released in the game with each bullet. The disintegration of this type of bullet is independent of the impact speed, because the compressed core disintegrates both at high impact speed and at low impact speed. In cores made from sintered materials or comprising binders in the compressed core, the disintegration of the core may be controlled by the sintered density or the binder content.

The size ratios of the two cores are determined by the desired shock effect and deep action in the body of game animals. If 50% of the core consists of compressed powder, a high shock effect with deep action is obtained, depending on the size of the powder particles. If 20% of the core consists of compressed powder, a low shock effect with deep action is obtained. The game is killed as a function of the size of the powder particles.

Figure 2:
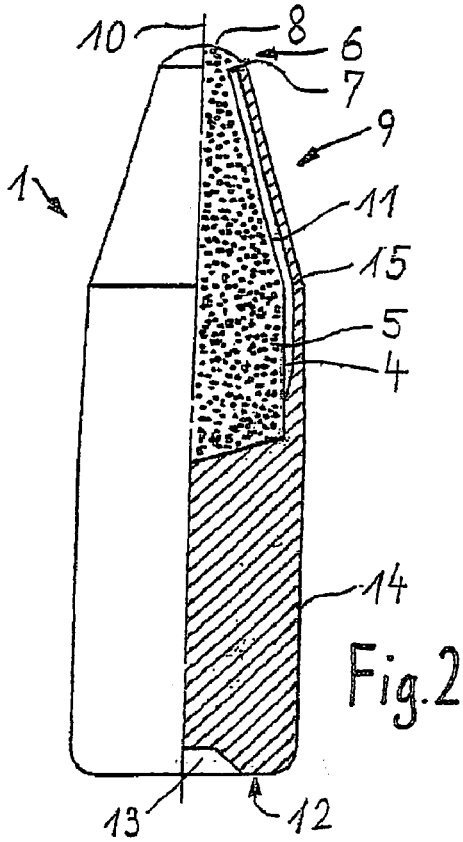
FIG. 2 is a schematic view, half in section, of a partially jacketed bullet in the form of a disintegrating bullet, the core arrangement corresponding to FIG. 1, comprising a solid tail core and a nose core, the jacket and the tail core being integral.

The embodiment according to FIG. 2 is comparable with that according to FIG. 1. The difference is that the tail core 14 and the jacket 15 are integral. The jacket 15 has been formed, by deep-drawing, from the material of the tail core 14 and surrounds the nose core 4, which consists of compressed powder 5 and forms the bullet tip 8. The advantages are similar to those of the bullet described in FIG. 1.

The embodiment according to FIG. 3 differs from the preceding embodiments basically in that the nose core is the solid core. The bullet 20 is also a partially jacketed bullet. The core material of the tail core 22, the powder 23, is initially added to the bullet jacket 21, which is initially non-deformed and open, and then compressed without cavities. A solid core 25, which is made from a suitable material for a bullet core, is then inserted as the nose core. The bullet jacket 21 is drawn onto the illustrated bullet shape. The bullet jacket 21 is not closed in the bullet nose 25. The bullet core 24 protrudes from the opening 26 in the jacket 21 and forms the bullet tip 27. In the ogival region 28, predetermined breaking points, in the form of grooves 30 pressed into the jacket 21, extend on the inside of the jacket 21 in the direction of the axis 29 of the bullet 20. A spherical indentation 32 is located in the tail 31 of the bullet 20 for stabilising the motion of the bullet and thus for increasing precision. The embodiment according to FIG. 4 is comparable with that according to FIG. 3. The difference is that the bullet jacket 21 has further features. What is known as a sharp edge 33, a notch, located on the outer perimeter of the jacket 21, with a sharp edge, which, in the case of hunting bullets, both causes a clean incision into the hide of the game animal and forms a further predetermined breaking point for the disintegration of the jacket 21, is located in the cylindrical region of the bullet 20. Two further holding grooves 34 are also located on the perimeter of the jacket 21. The core is fixed by deformation of the jacket. These holding grooves 34 also help to reduce friction in the gun barrel. The additional features of the bullet jacket are not restricted to the present embodiment. The embodiments of FIG. 1 to 3 may also be configured with a sharp edge and/or at least one holding groove. The disintegration of the bullet may, as described above, be controlled using tearing edges, for example in the form of a sharp edge, and holding grooves.

The invention claimed is:

1. Disintegrating bullet in the form of a jacketed bullet, the bullet comprising a pair of bullet cores, of which a bullet core comprises, in solid form, a metallic material suitable for bullets, characterised in that another bullet core comprises powder made from a ceramic material, in that a particle size of the powder is between 5 μm and 1 mm, and in that the powder is compressed so as to be without cavities.

2. Disintegrating bullet according to claim 1, characterised in that the solid bullet core is disposed in the tail of the bullet.

3. Disintegrating bullet according to claim 1, characterised in that the solid bullet core is arranged in the nose of the bullet and forms the bullet tip.

4. Disintegrating bullet according to claim 1, characterised in that powder of the ceramic material is at least one of aluminium oxide, zirconium oxide, and silicon nitride.

5. Disintegrating bullet according to claim 4, characterised in that powder of the ceramic material comprises aluminium oxide.

6. Disintegrating bullet according to claim 1, characterised in that when the powder is compressed it is mixed with binders or with cavity-filling material.

7. Disintegrating bullet according to claim 1, characterised in that each of the bullet cores is introduced into the jackets in prefabricated form or is compressed in the jacket.

8. Disintegrating bullet according to claim 1, characterised in that the solid core comprises compressed balls or granules.

9. Disintegrating bullet according to claim 1, characterised in that the solid core comprises sintered material.

10. Disintegrating bullet according to claim 1, characterised in that the bullet jacket has predetermined breaking points.

11. Disintegrating bullet according to claim 9, characterised in that the predetermined breaking points extend in the direction of the bullet axis.

12. Disintegrating bullet according to claim 1, characterised in that the material of the bullet jacket comprises copper, alloys thereof, plated steel, soft iron or zinc/tin alloys.

13. Disintegrating bullet according to claim 1, characterised in that the bullet has a spherical indentation in the tail region.

14. Disintegrating bullet according to claim 1, characterised in that the bullet has a sharp edge on its outer perimeter.

15. Disintegrating bullet according to claim 1, characterised in that the bullet has holding grooves on its outer perimeter.

16. Disintegrating bullet according to claim 1, characterised in that the solid bullet core is disposed in the tail of the bullet, and the solid bullet core and the jacket are integral.

17. Disintegrating bullet according to claim 15, characterised in that the jacket has been formed by deep-drawing from the material of the tail core, and surrounds a nose core which comprises compressed powder and forms the bullet tip.

18. A disintegrating bullet in the form of a jacketed bullet, the bullet comprising:

a solid bullet core made from a metallic material;

another bullet core made from a powder of a ceramic material;

wherein a particle size of the powder is between 5 μm and 1 mm; and wherein the powder is compressed so as to be without cavities.

19. A disintegrating bullet according to claim 18, wherein the solid bullet core is disposed in the tail of the bullet.

20. A disintegrating bullet according to claim 18, wherein the powder of the ceramic material is at least one of aluminium oxide, zirconium oxide, and silicon nitride.

21. A disintegrating bullet according to claim 20, wherein the powder of the ceramic material comprises aluminium oxide.

22. A disintegrating bullet according to claim 18, wherein the bullet jacket has predetermined breaking points.

* * * * *